United States Patent [19]

Ballinger

[11] 4,326,347

[45] Apr. 27, 1982

[54] NARROW DITCH TRENCHER

[76] Inventor: Paul V. Ballinger, Findlay, Ohio

[21] Appl. No.: 229,741

[22] Filed: Jan. 29, 1981

Related U.S. Application Data

[63] Continuation of Ser. No. 34,672, Apr. 30, 1979, abandoned.

[51] Int. Cl.[3] ..... E02F 5/08

[52] U.S. Cl. ..... 37/94; 37/DIG. 2; 405/180

[58] Field of Search ..... 37/94–97, 37/189–190, DIG. 2, 89, 91–93, 80 R, 142.5, 142 R, 70; 405/180, 182, 183, 154, 157, 159, 161, 174, 177, 178; 198/703, 705

[56] References Cited

U.S. PATENT DOCUMENTS

| | | | |
|---|---|---|---|
| 1,301,344 | 4/1919 | Wehner | 37/94 |
| 1,406,849 | 2/1922 | Greimann | 198/705 |
| 1,449,223 | 3/1923 | Greimann | 198/705 |
| 1,472,563 | 10/1923 | Loken | 37/94 |
| 1,521,236 | 12/1924 | Franks | 37/91 |
| 2,472,758 | 6/1949 | Przybylski | 37/DIG. 2 |
| 2,663,241 | 12/1953 | Howard | 37/189 X |
| 2,782,534 | 2/1957 | Wall | 37/DIG. 2 |
| 3,049,816 | 8/1962 | Shimp | 37/DIG. 2 |
| 3,203,188 | 8/1965 | Evans | 37/142.5 X |
| 3,429,134 | 2/1969 | Coffey | 405/177 X |
| 3,610,691 | 10/1971 | Penote et al. | 37/94 X |
| 3,680,919 | 8/1972 | Rear | 37/94 X |
| 3,783,537 | 1/1974 | Penote et al. | 37/94 |
| 4,110,920 | 9/1978 | Brown | 37/189 X |
| 4,179,829 | 12/1979 | Kinkade | 37/94 |

FOREIGN PATENT DOCUMENTS

| | | | |
|---|---|---|---|
| 110309 | 4/1944 | Sweden | 37/91 |
| 424391 | 2/1935 | United Kingdom | 37/93 |
| 689985 | 4/1953 | United Kingdom | 37/189 |

*Primary Examiner*—E. H. Eickholt

*Attorney, Agent, or Firm*—Wilson, Fraser, Barker & Clemens

[57] ABSTRACT

A trencher for escavating narrow channels in soil comprises a power driven wheel rotating about a transverse, horizontal axis and a plurality of buckets disposed about its periphery. The wheel includes a pair of circular gear racks disposed inwardly from its periphery and symmetrically about the vertical midplane of the wheel. A pair of pinions, engaging the pair of racks, symmetrically applies driving energy to the wheel. Each of the buckets comprises an arcuate cutter face and undercut, arcuate, longitudinal body portion which is secured to the wheel by a flat spoke extending radially outwardly from the vertical midplane of the wheel. The trencher also includes two pairs of arms disposed on opposite sides of the wheel and bucket spokes. As the wheel and buckets rotate, soil is engaged, lifted above ground level and emptied from the buckets by the pairs of arms. Trenches for plastic drain pipe, for example, as deep as six feet and no wider than one foot may be dug by the trencher of the instant invention at speeds as great as forty feet per minute.

10 Claims, 17 Drawing Figures

FIG. 4
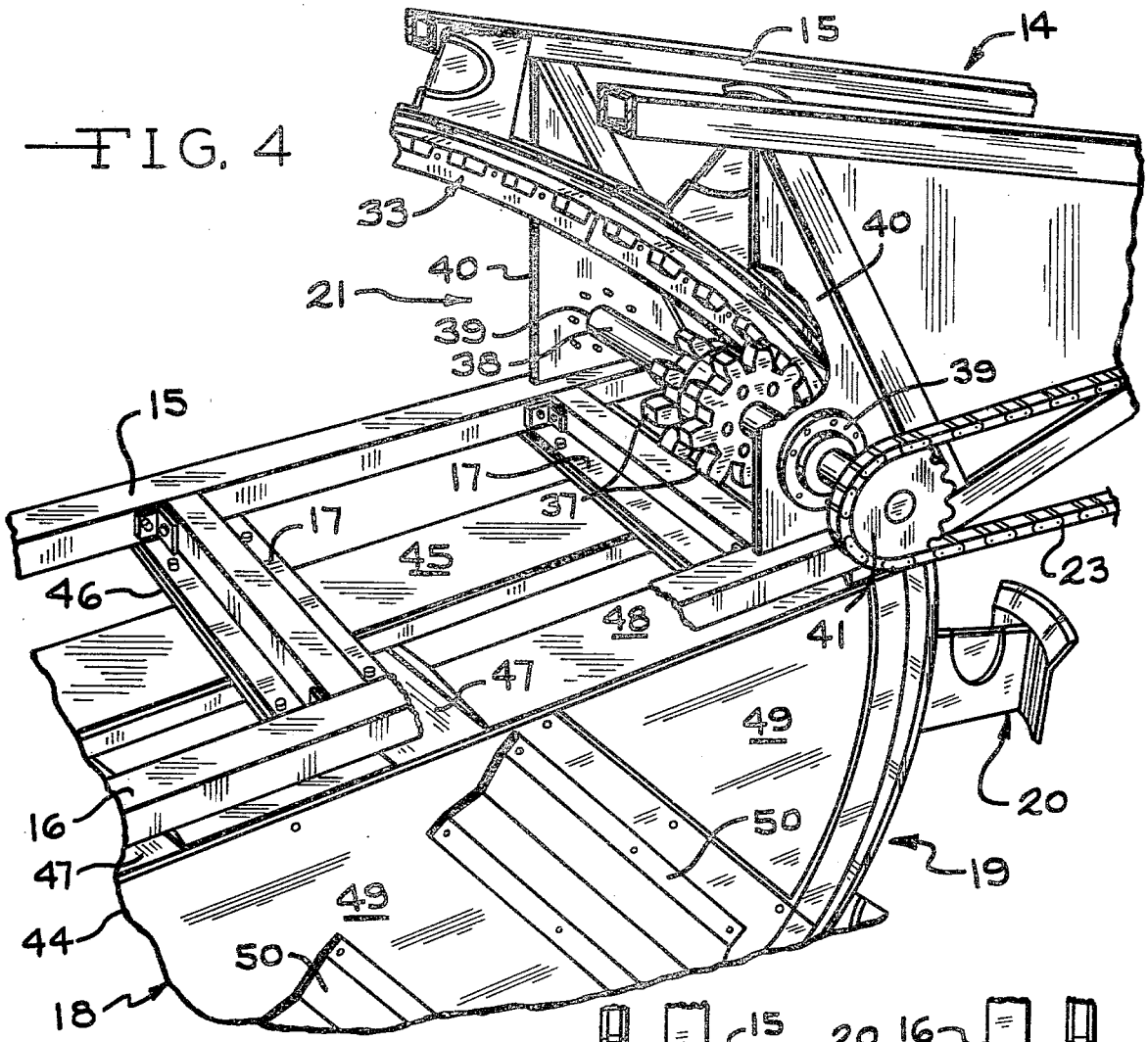
FIG. 5
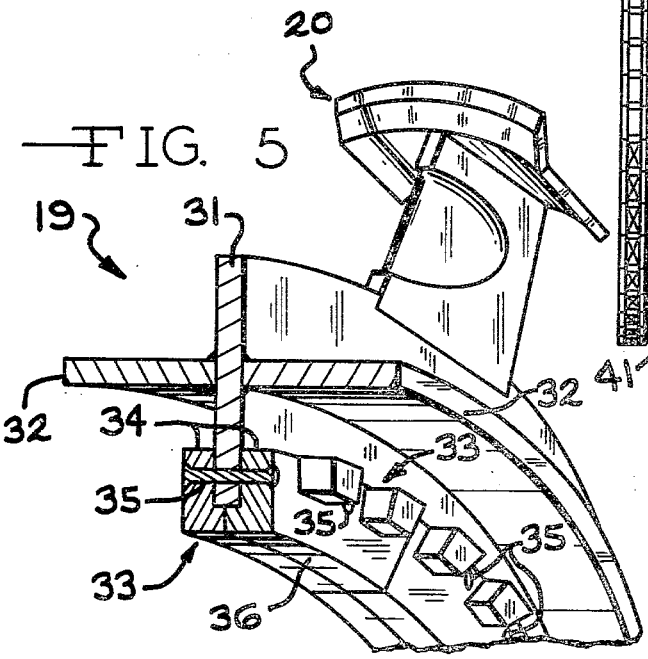
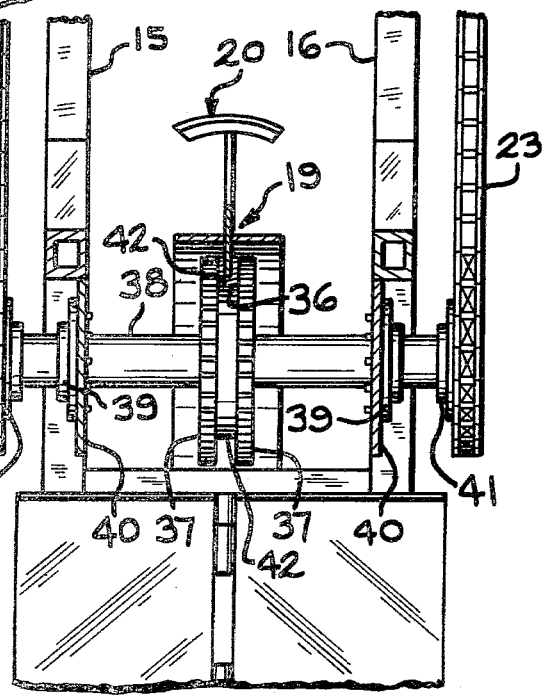
FIG. 6

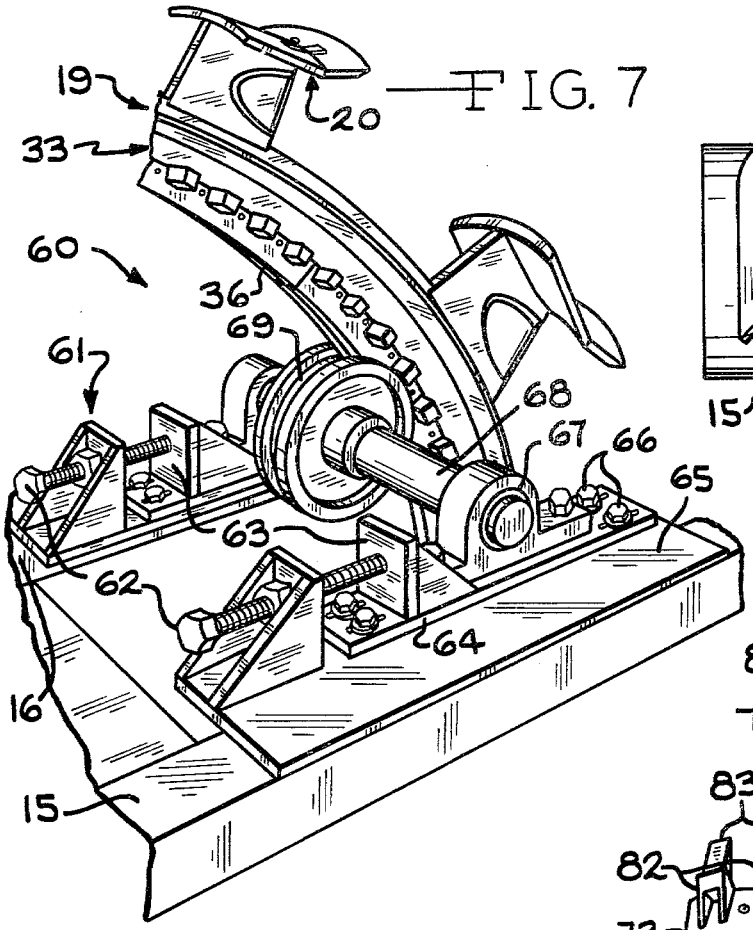
FIG. 7
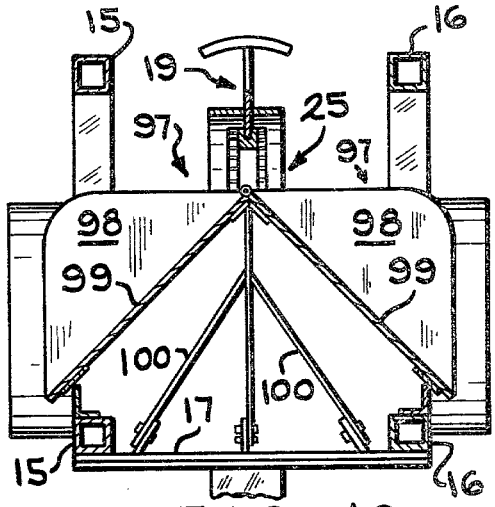
FIG. 10
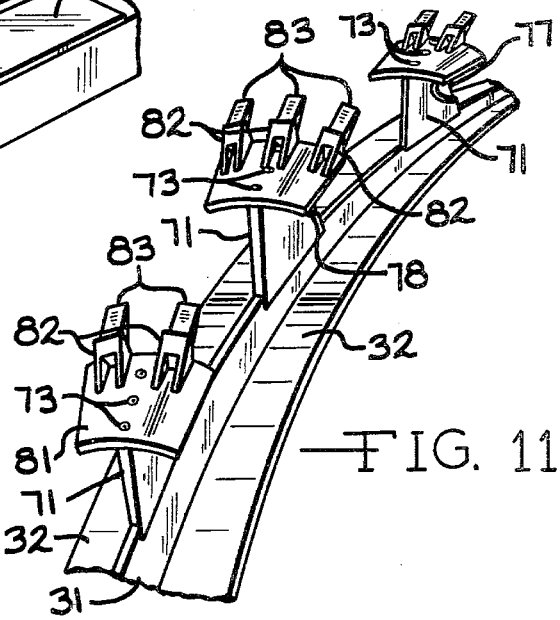
FIG. 11
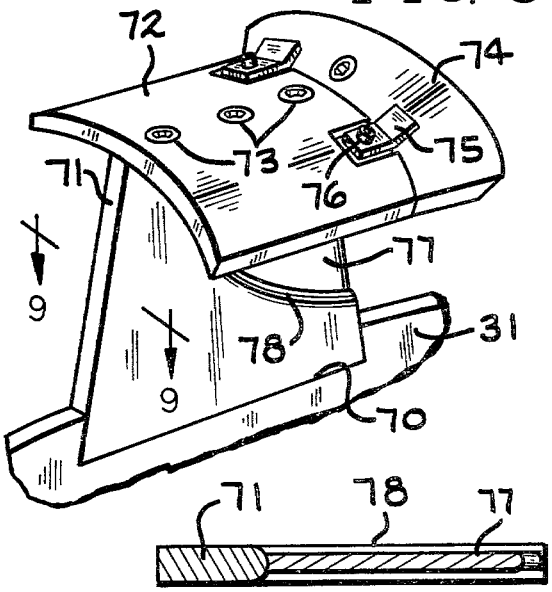
FIG. 8
FIG. 9
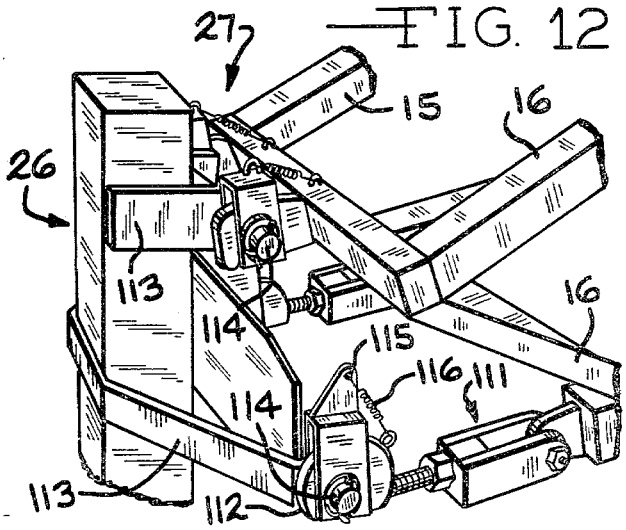
FIG. 12

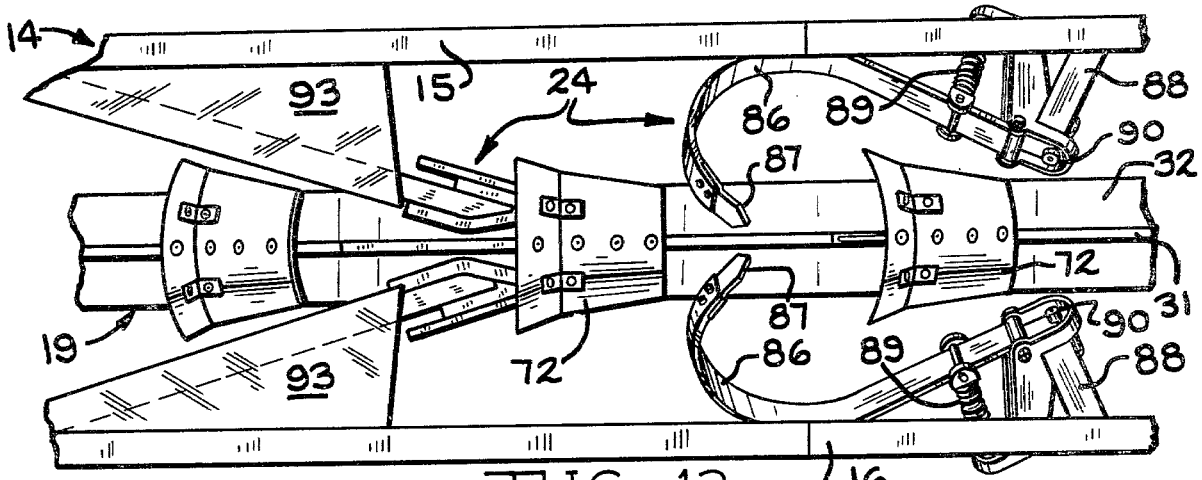
FIG. 13
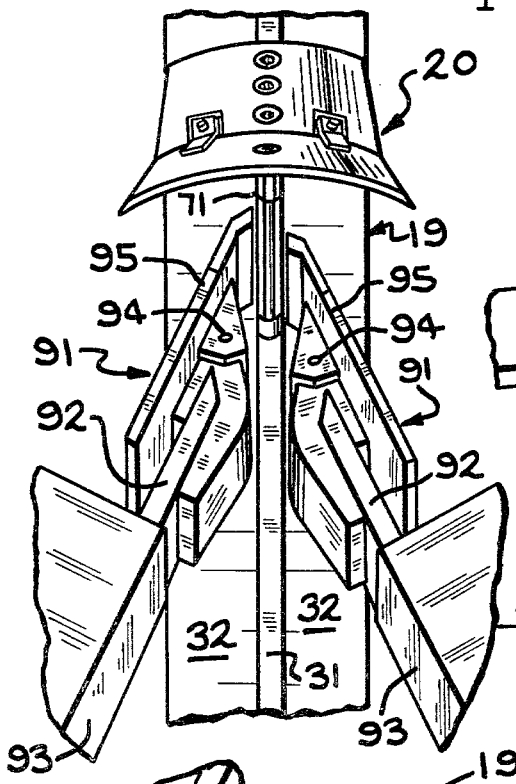
FIG. 14
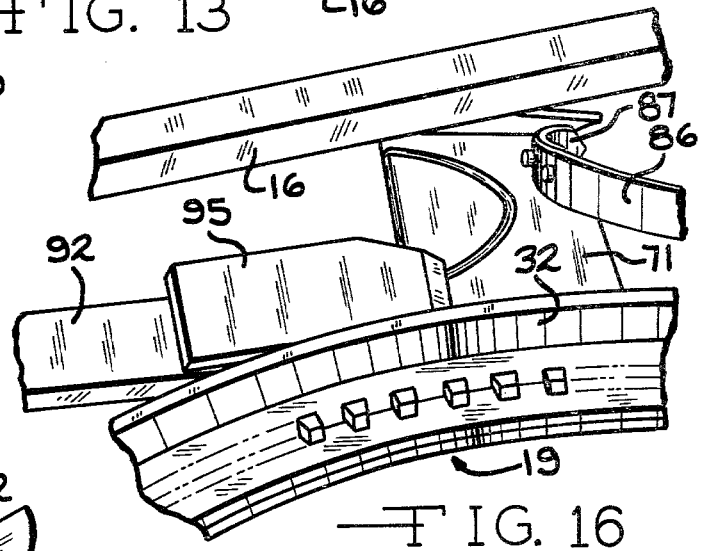
FIG. 16
FIG. 17
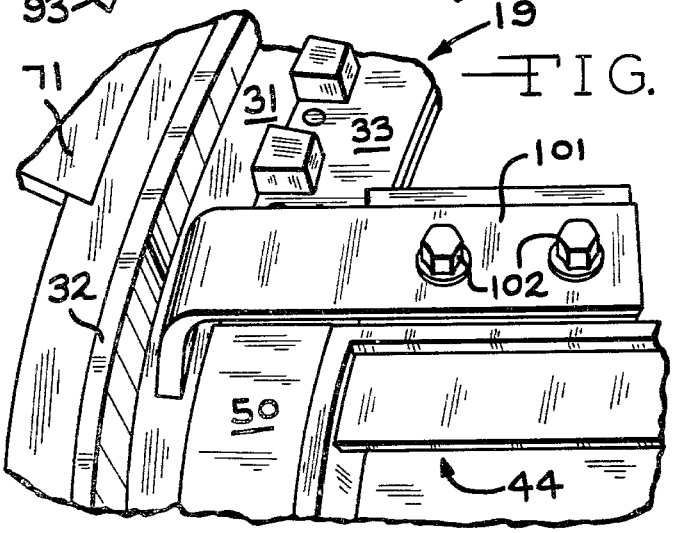
FIG. 15
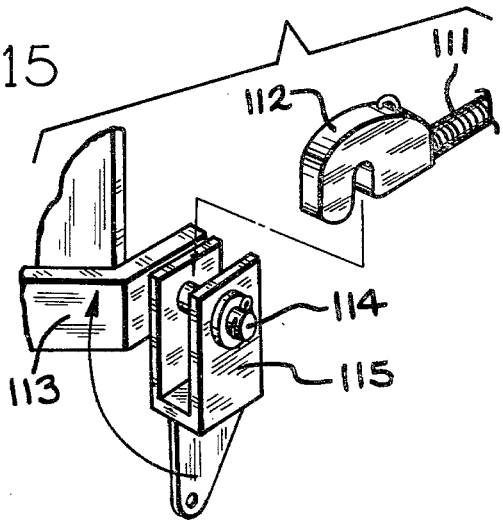

NARROW DITCH TRENCHER

This is a continuation of application Ser. No. 34,672 filed Apr. 30, 1979 now abandoned.

BACKGROUND OF THE INVENTION

Emphasis on improved farming yields per acre as well as the reclamation of heretofore unsuitable land areas for housing, agriculture and silviculture has developed the drainage industry into a burgeoning field of enterprise. This growth has been encouraged by the development of lightweight, inexpensive polyvinylchloride (PVC) plastic pipe which has virtually replaced the heavier more expensive ceramic tile that was the mainstay of the industry twenty five years ago. In addition to its lower cost, PVC pipe's popularity also results from its adaptability to rapid, continuous installation since it is manufactured in continuous lengths up to 5,000 feet which do not require joining or sealing at repeated intervals. Thus, the cost savings associated with both such plastic continuous length pipes and its simplified and rapid installation have encouraged increased utilization of this means of improving crop yield or reclaiming otherwise unusable land areas. PVC drain pipe and drain pipe fabricated of other plastic materials now accounts for nearly all of the drain pipe installed in the United States.

Technological improvements in the equipment which trenches the soil and installs such plastic drain pipe have not been as great. Much conventional trenching equipment is available but it has generally been found to be unsuitable for drain pipe trenching applications. The most common type of trencher vaguely resembles a ferris wheel and comprises a plurality of fixed buckets transversely positioned between two rigid circular frames. The frames include gear drive teeth disposed about their outer peripheries which are engaged by a pair of drive sprockets which are powered by a prime mover. The sprockets disposed on the outer periphery of the rotating wheel tend to snag and collect roots and other debris. Therefore, it has been found necessary to secure outwardly extending side rooters to the circular frame. A trench which is dug with a bucket from ten to twelve inches in width must be at least three inches greater in width on each side due to the circular frame and another three inches wide on each side because of the side rooters. A bucket from ten to twelve inches wide may thus produce a trench nearly two feet in width. Digging a trench two feet wide to receive a six inch drain pipe is highly undesirable from both energy and ecology standpoints since not only is an unnecessary quantity of soil displaced but also such soil must be replaced.

The apparent solution of narrowing the width of the bucket itself is only illusory inasmuch as this dual frame design necessarily produces a trench approximately one foot wider than the bucket width. Hypothetically, the only way a trencher of this design could produce a trench one foot wide would be to construct it without buckets, circular frames or side rooters. It is apparent that such approaches are not feasible.

A trencher of conventional design incorporating buckets approximately three to four inches wide which would dig a trench approximately sixteen inches wide will encounter several difficulties. The major difficulty with such a narrow bucket is that of emptying it when digging in dense or wet soil, particularly clay. The dense soil tends to compact within the bucket and requires substantial additional scraping and cleaning components which will be vulnerable to damage by rocks within the buckets and which will substantially increase the energy requirements of the trenching wheel. In other words, the ease with which a conventional bucket may be emptied or the probability that such a conventional bucket will empty itself is in direct proportion to the size of the bucket. A bucket which fails to empty functions more as a wedge than a scoop—further increasing the horsepower requirements of the trencher while decreasing its digging and earthmoving capability.

SUMMARY OF THE INVENTION

The instant invention is directed to a narrow ditch trencher specifically adapted to dig trenches in conjunction with the installation of plastic drain pipe. The trencher comprises an open frame which rotatably supports an annular wheel on a horizontal axis, transverse to the trench. The wheel includes a plurality of buckets disposed about its periphery and secured thereto by radially extending webs or spokes. Each of the buckets includes an outer arcuately curved wall having its concave surface secured to the radially extending web. The bucket has no side or rear structure as such but the leading edge of the bucket extends radially outwardly further than the trailing edge of the bucket and the arcuate curve of the outer surface is sufficient to entrain and lift the soil.

Symmetrically disposed on the left and right side of the inner surface of the wheel is a symmetrical pair of gear racks which are engaged respectively by a left and right side sprocket drive which is rotatably secured within the frame of the trencher. The wheel and buckets are thus caused to rotate by power symmetrically applied to the wheel through the gear sprockets. A generally semi-circular structure disposed within the wheel is secured to the frame, positions and supports the wheel and occupies the space within the wheel thereby preventing accumulation of spoil therein.

The trencher also comprehends a trailing shoe which stabilizes the trencher at the bottom of the freshly cut trench. If the trencher is being utilized to cut a drain pipe trench and install it, openings within the shoe direct the drain pipe to the bottom of the trench where rollers mounted within the trailing portion of the shoe properly position the drain pipe at the bottom of the trench.

The trencher according to the instant invention is thus specifically adapted for use in digging trenches for drain pipe. As such, it is capable of digging a trench approximately one foot wide to a depth of approximately six feet at forward speeds as great as forty feet per minute. Since the trencher upsets and removes only sufficient soil to ensure the proper installation of the drain tile, it exhibits several advantages. First of all, the overall horsepower requirement is minimized and the energy efficiency of the trenching operation is maximized. Secondly, since a minimum of soil is raised to the surface during the trenching operation, the difficulty and thus cost of backfilling the trench as well as the overall disturbance to the land and ecology of the area is minimized. Finally, although the bucket and wheel configuration is wholly suitable for scaling up to substantially larger sized machines, the drain pipe trenching machine of the instant invention is uniquely compact and portable. By obviating the necessity of obtaining special permits to move such equipment from job site to job site, a drain pipe trenching and installation contractor also enjoys peripheral benefits.

Therefore, it is an object of the instant invention to provide a trenching machine capable of digging narrow trenches.

It is a further object of the instant invention to provide a trenching machine capable of digging narrow trenches through various soil and rock conditions.

It is a still further object of the instant invention to provide a trenching machine capable of rapidly and efficiently digging trenches in connection with the installation of plastic drain pipe.

It is a still further object of the instant invention to provide a trenching machine which is compact and easily transportable from job site to job site.

Further objects and advantages of the instant invention will be apparent upon referring to the following specification and claims.

BRIEF DESCRIPTION OF THE DRAWINGS

FIG. 4 is a fragmentary perspective view of the symmetrical drive mechanism of the narrow ditch trencher;

FIG. 5 is a fragmentary sectional view of the trenching wheel assembly of the narrow ditch trencher;

FIG. 6 is a fragmentary, sectional view of the symmetrical sprocket drive taken along line 6—6 of FIG. 1;

FIG. 7 is an enlarged perspective view of an upper, adjustable trenching wheel support;

FIG. 8 is an enlarged perspective view of a trencher bucket according to the preferred embodiment;

FIG. 9 is a sectional view of the trencher bucket spoke taken along line 9—9 of FIG. 8;

FIG. 10 is a fragmentary sectional view of the debris and spoil aprons taken along line 10—10 of FIG. 1;

FIG. 11 is a fragmentary, perspective view of the trencher wheel and bucket assemblies according to a first alternate embodiment;

FIG. 12 is an enlarged, fragmentary, perspective view of the interconnecting linkage between the frame of the trencher and the trencher shoe;

FIG. 13 is a fragmentary, top plan view of the narrow ditch trencher illustrating the spoil removal assemblies;

FIG. 14 is an enlarged, fragmentary perspective view of the narrow ditch trencher illustrating the spoke scraping assemblies;

FIG. 15 is an enlarged, fragmentary perspective view illustrating a spoil and rock cleaner disposed adjacent the trencher wheel;

FIG. 16 is an enlarged, fragmentary perspective view of the narrow ditch trencher further illustrating the spoil removal assemblies; and FIG. 17 is an enlarged, fragmentary, perspective view of a locking mechanism of the interconnecting linkage of the narrow ditch trencher.

DESCRIPTION OF THE PREFERRED EMBODIMENT

Figure 1:
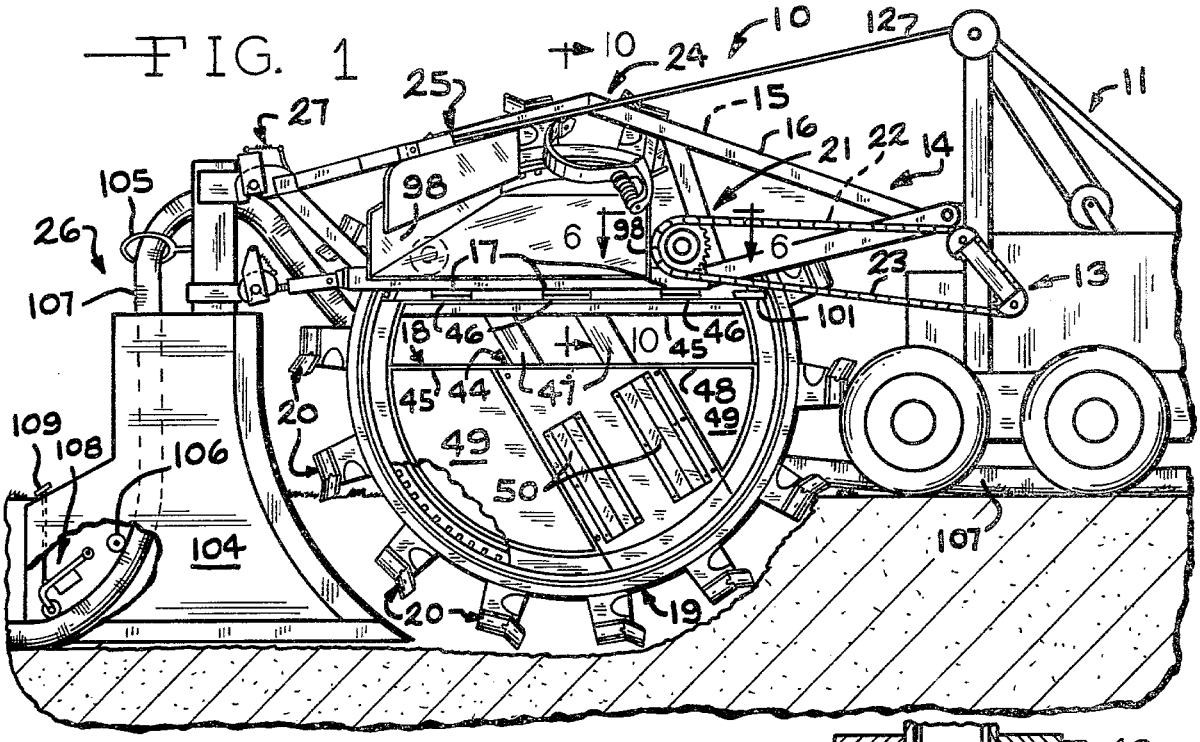
FIG. 1 is a side elevational view of a narrow ditch trencher according to the instant invention.

Referring now to FIG. 1, a narrow ditch trencher according to the instant invention is generally designated by the reference numeral 10. The trencher 10 is shown in conjunction with a prime mover such as a wheel type tractor 11. The tractor 11, which forms no part of the instant invention, includes a cable and winch assembly 12 which may be utilized to raise and lower the narrow ditch trencher 10 and a power takeoff 13 which provides rotary power to the trencher 10. Inasmuch as the tractor 11 is conventional and its structure and operation would be readily understood by one skilled in trencher art, it will not be further described. The trencher 10 includes a rigid frame assembly 14 which may be fabricated of welded, steel box girders. The frame assembly 14 generally comprises a pair of spaced-apart, left and right pentagonal frame members 15 and 16, respectively. Transverse braces 17 interconnect the left and right pentagonal frame members 15 and 16 and support a generally semi-circular wheel mounting assembly 18. The wheel mounting assembly 18 is disposed symmetrically about the vertical midplane of the frame 14 and rotatably mounts a trenching wheel assembly 19. Uniformly disposed about the periphery of the trencher wheel assembly 19 is a plurality of bucket assemblies 20. The trenching wheel assembly 19 is driven by a symmetrical drive assembly 21 which is supplied power from the power takeoff 13 of the tractor 11 through a pair of left and right chains 22 and 23, respectively.

Substantially symmetrically disposed within and proximate the upper portion of the frame assembly 14 is a spoil removal assembly 24. Two chute assemblies 25 are symmetrically disposed within the trenching wheel assembly 19 and are supported by the left and right pentagonal frame members 15 and 16. At the rear of the narrow ditch trencher 10 is a shoe assembly 26 which is removably secured to the frame assembly 14 by means of a plurality of locking mechanisms 27.

Inasmuch as the narrow ditch trencher 10 of the instant invention is conveniently divisible into discrete assemblies, namely, the wheel assembly 19 and the drive assembly 21, the wheel support assembly 18, the bucket assemblies 20, the spoil removal assemblies 24 and the shoe assembly 26, these assemblies will be serially and individually described in the following five sections of the Description of the Preferred Embodiment. A final section, directed to the operation of the narrow ditch trencher 10 completes this Description.

WHEEL AND DRIVE ASSEMBLIES

Referring now to FIGS. 4 and 5, the trenching wheel assembly 19 and the symmetrical drive assembly 21 are illustrated. The wheel assembly 19 includes a flat annulus 31. The annulus 31 is disposed coincident with the vertical midplane of the frame assembly 14 and supported by the wheel support assembly 18 which will be described subsequently. The annulus 31 generally defines the trenching wheel assembly 19 and it, as well as the other structures of the narrow ditch trencher 10, may be fabricated of any suitable high strength steel alloy. Secured, by welding or other suitable means, to the outer peripheral edge of the annular disk 31 are a plurality of bucket assemblies 20. These buckets assemblies 20 will also be described subsequently. Symmetrically disposed inwardly from the outer peripheral edge of the annulus 31 and perpendicular thereto are a pair of circular support rails 32 which provide lateral support and strengthening to the annulus 31. The support rails 32 are preferably secured to the annulus 31 by welding or other suitable securement means. Operation of the trencher 10 is significantly enhanced by cooperation between the support rails 32 and the bucket assemblies 20 which will be described subsequently. Disposed symmetrically about the annulus 31 and radially inwardly from the support rails 32 are a pair of circular gear racks 33. The gear racks 33 are symmetrically disposed about the vertical midplane of the trenching wheel assembly 19 and form an endless gear path adjacent the inner periphery of the annulus 31. Preferably, the circular gear racks 33 comprise arcuate, L-shaped segments 34 which are secured to the annulus 31 in opposed relationship by a plurality of rivets 35 or similar fasteners. The gear rack segments 34 are preferably joined along their abutting ends by welding or other suitable bonding means. The segments 34 define an inner roller surface 36 which cooperates with wheel support assemblies 18 to rotatably support the trenching wheel assembly 19.

Although it should be apparent that the circular gear racks 33 may comprehend merely a pair of appropriately toothed, mirror-imaged annuli which are cojoined on opposite faces of the annulus 31 to form the roller surface 36 and secured by appropriate fastening means, it should be apparent that the use of a plurality of arcuate segments 34 provides improved serviceability. Utilization of a plurality of segments 34 allows rapid and inexpensive replacement of an individual damaged gear tooth since such a construction necessitates only the removal and replacement of an individual segment 34.

Referring now to FIGS. 4 and 6, the trenching wheel assembly 19 is supported coincident with the vertical midplane of the frame assembly 14 by the wheel support assembly 18. The symmetrical drive circular gear racks 33. The gear pinions 37 are secured to a transverse shaft 38 rotatably journaled within a pair of bearings 39. The bearings 39 are secured to and supported by triangular supports 40 which may be secured by weldments to the left and right frame member 15 and 16. Each end of the transverse shaft 38 is terminated by a chain sprocket 41. The chain sprocket 41 on the left side of the narrow ditch trencher 10 is engaged by the left chain 22 and the right sprocket 41 is similarly engaged by the right chain 23. The left and right chains 22 and 23 are driven from the left and right sides, respectively, of the power takeoff 13 of the tractor 11. Power is thus transferred through the left and right chains 22 and 23 through the transverse shaft 38 and the gear pinions 37 and to the circular gear racks 33 and thus the trenching wheel assembly 19, causing rotation thereof. Alternatively, the trencher 10 may include hydraulic motors driven by pressurized hydraulic fluid supplied by the tractor 11 or other source.

Referring briefly to FIG. 6, it should be noted that the symmetrical drive assembly 21 also includes a shoulder 42 disposed between the gear pinions 37. The shoulder 42 provides a fixed bearing support surface against which the wheel assembly 19 and specifically the inner roller surface 36 rotates. The shoulder 42 thus thus also ensures the proper mesh of the gear pinions 37 with the gear racks 33.

WHEEL SUPPORT ASSEMBLIES

Referring now to FIGS. 1 and 4, the wheel support assembly 18 includes a generally semi-circular support frame 44 which is disposed concentrically within and supports the wheel assembly 19. The support frame 44 includes a member 45 which is secured by welding or other suitable permanent means to a plurality of transverse braces 46 which align with and may be removably secured to the transverse braces 17 which form a portion of the frame assembly 14 by conventional threaded fasteners. The support frame 44 also includes angularly disposed box girder braces 47 and a horizontal top plate 48.

It should be noted that the support frame 44 serves two functions. First of all, it provides structural support for the trenching wheel assembly 19. As such, it should be appreciated that the bracing and support members described above are preferably fabricated of high strength steel alloys. Second of all, the vertical sidewalls of the support frame 44 comprise a plurality of removable panels 49 and covers 50. The panels 49 and the covers 50 close off the support frame 45 and bracing structure within the frame 45 and provide smooth profile sidewalls within the interior of the wheel 19 which inhibit the accretion of soil and other foreign matter within this portion of the trencher 10.

Figure 2:
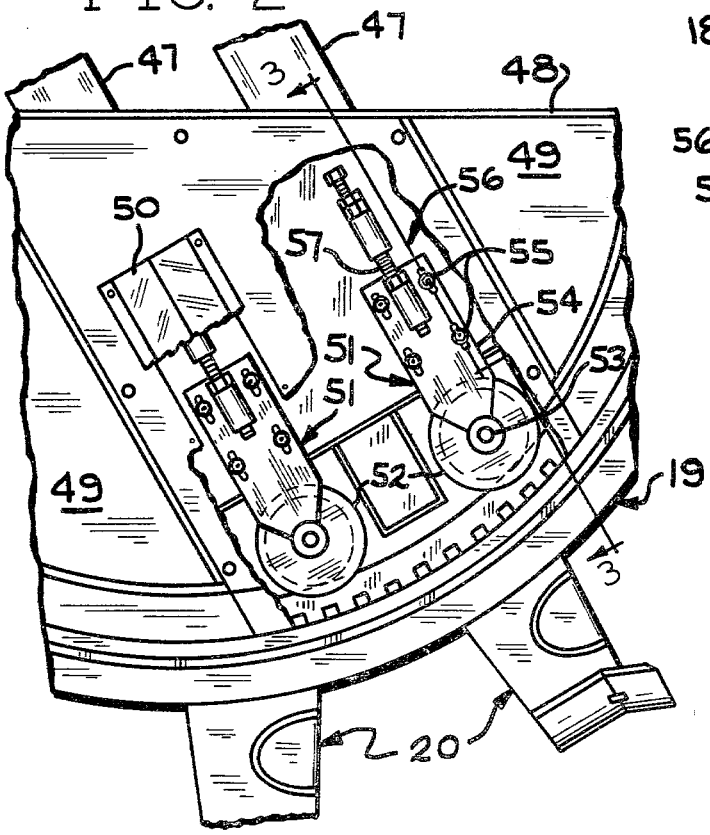
FIG. 2 is an enlarged, fragmentary side elevational view of the adjustable wheel support assemblies of the narrow ditch trencher.
Figure 3:
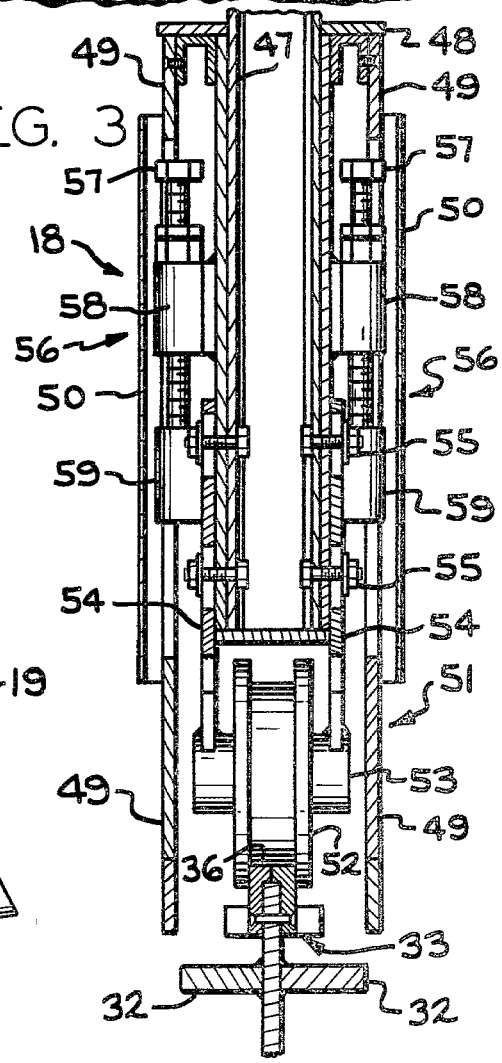
FIG. 3 is a fragmentary sectional view of a wheel support assembly of the narrow ditch trencher taken along line 3—3 of FIG. 2.

Referring now to FIGS. 2 and 3, the covers 50 protect two adjustable wheel support assemblies 51 which include a roller 52 rotatably mounted upon a fixed transversely disposed stub shaft 53. Preferably, the rollers 52 include anti-friction bearings (not illustrated), such as cup and cone bearings disposed therewithin to minimize friction between them and the stub shafts 53. The stub shaft 53 is removably secured to a pair of parallel support struts 54. The support struts 54 are disposed adjacent parallel sidwalls of the angular box girder braces 47. A plurality of conventional threaded fasteners 55 positioned between the box girder braces 47 and the parallel struts 54 selectively allow maintenance or adjustment of the position of the parallel struts 54 and the rollers 52. The adjustable roller assemblies 51 further include a pair of threaded adjustment mechanisms 56. The adjustment mechanisms 56 comprise conventional threaded bolts 57, a threaded collar 58 secured to the support frame 44 and an unthreaded retaining collar 59 secured to the parallel struts 54. Rotation of the bolts 57 associated with a given roller adjustment mechanism 51 may thus be utilized to achieve controlled inward and outward radial motion of the roller 52 to adjust the general position of the wheel trenching assembly 19 relative to the support frame 44. It should be apparent from FIG. 3, that the rollers 52 support the trenching wheel assembly 19 on the inner roller surface 36 which is formed by the circular gear racks 33. It should also be noted that the panels 49 in the forward portion of the frame assembly 44 extend radially outwardly into close proximity with the support rails 32 (See also FIG. 1).

Referring now to FIG. 7, the wheel support assembly 18 also is seen to include a roller mechanism 60 disposed in the upper left portion of the narrow ditch trencher 10. The view of the roller mechanism 60 in FIG. 7 is from the left side of the trencher 10. The left and right frame members 15 and 16, respectively, support an adjustment mechanism 61 which comprises a pair of threaded bolts 62 which align with and contact perpendicular stops 63. The perpendicular stops 63 are secured to slidable horizontal brackets 64 which may be selectively secured to mounting plate 65 which are in turn permanently secured to the frame members 15 and 16 by welding or other permanent attachment means. A plurality of threaded fasteners 66 are utilized to secure the horizontal bracket 64 to the mounting plate 65. Also, affixed to the horizontal bracket 64 are a pair of of conventional pillow blocks 67 which rotatably position a stub shaft 68 upon which is disposed a roller 69. In a manner similar to the rollers 52 of the adjustable roller assemblies 51, the roller 69 engages and supports the trenching wheel assembly 19 on the inner roller surface 36 of the gear racks 33. Adjustment of the longitudinal position of the roller 69 relative to the frame assembly 14 and trenching wheel assembly 19 may be achieved by loosening the threaded fasteners 66, adjusting the threaded bolts 62 and the brackets 64 as necessary, and retightening the threaded fasteners 66.

It can thus be appreciated that the wheel support assembly 18, comprising the support frame 44, the adjustable roller assemblies 51 and the roller mechanism 60 rotatably position and support the trenching wheel assembly 19 within the frame assembly 14. Adjustability provided by the various adjustment mechanisms permits centering the trenching wheel assembly 19 within the support frame 45 to compensate for wear and other minor dimensional changes over the life of the narrow ditch trencher 10. A further advantage of the wheel support assembly 18 is the separability of the pairs of transverse braces 17 and 46 which permits removal of the entire support frame 44 and thus the removal and replacement of the entire trenching wheel assembly 19.

BUCKET ASSEMBLIES

Referring now to FIG. 8, an individual bucket assembly 20 which is utilized on the narrow ditch trencher 10 is illustrated. The bucket assemblies 20 are secured within notches 70 in the outer peripheral edge of the flat annulus 31 of the trenching wheel assembly 19 by welding or other suitable means. The bucket assemblies 20 comprise a radially extending spoke 71 having outwardly tapering front and trailing edges. Disposed transversely against the outer edge of the spoke 71 is an arcuate bucket plate 72 which is secured to the spoke 71 by a plurality of recessed, threaded fasteners 73. The leading edge of the bucket assembly 20 is defined by an outwardly flared conical blade 74. The conical blade 74 is removably secured to the spoke 71 by at least one recessed fastener 73 and to the arcuate bucket plate 72 by means of brackets 75 and threaded fasteners 76. Preferably, the conical blades 74 are oriented at an angle between 15° and 25° to a circle generally defined by the loci of the bucket assemblies 20.

Referring now to FIGS. 2, 11 and 12, the leading edge of the spoke 71 defines a centrally disposed insert 77 of reduced thickness which extends toward the rear of the bucket spoke 71 in a generally ellipsoidal notch 78. This ellipsoidal pattern may most conveniently by removing the metal of the spoke 71 in the ellipsoidal notch 78 and inserting and securing by welding or other suitable means a complementarily shaped insert. The reduced thickness insert 77 and the ellipsoidal left and right margins formed by the notch 78 improve the filling and emptying characteristics of the bucket assemblies 20.

Referring now to FIG. 11, an alternate embodiment of the bucket assemblies 20 is illustrated. The alternate embodiment bucket assemblies 20 include the radially extending spokes 71 of the preferred embodiment as well as the reduced thickness insert 77 positioned within the ellipsoidal notch 78. An arcuate bucket plate 81, rather than providing mounting for a conical blade, includes mounting assemblies or rooters 82 which removably accept and secure a cutter tooth insert 83. The arcuate bucket plates 81 include either two or three rooters 82 which mount a like number of cutter inserts 83. The arcuate bucket plates 82 having two cutter inserts 83 are secured to the spokes 71 in alternation with the arcuate bucket plates 81 having three cutter inserts 83 as illustrated in FIG. 11. The leading edges of the cutter inserts 83 thus alternately but evenly apply concentrated digging force to the soil. It should be noted that, inasmuch as only the arcute bucket plates 72 and conical blades 74 of the preferred embodiment are different from the arcuate bucket plates 81 and the attached mounting assemblies 82 and cutter inserts 83 of the alternate embodiment, conversion from the bucket and blade or cutter scheme of one embodiment to the other embodiment requires merely the removal and replacement of one set of components by the other; replacement which is facilitated by the recessed fasteners 73.

SPOIL REMOVAL ASSEMBLIES

Referring now to FIG. 13, the spoil removal assembly 24 is seen to include a pair of opposed, spring-tensioned cleaning arms 86. The cleaning arms 86 are disposed symmetrically about the vertical midplane of the trenching wheel assembly 19 and the frame 14. The cleaning arms 86 include hardened, replaceable tips 87 which are positioned proximate the left and right intersections of the spokes 71 with the arcuate bucket plates 72. This positioning is best illustrated in FIG. 16. The cleaning arms 86 are pivotally secured to a pair of inwardly directed mounting brackets 88 which also provide mounting for a pair of compression springs 89 which spring tension the cleaning arms 86. The cleaning arms 86 and specifically the tips 87 thus scrape and remove compacted spoil from the bucket assemblies 20 during passage of the trenching wheel assembly 19 thereby.

Referring now to FIG. 14, the spoil removal assembly 24 also includes a pair of spoke scraping assemblies 91. The spoke scraping assemblies 91 are disposed substantially symmetrically about the vertical midplane of the trenching wheel assembly 19. The spoke scraping assemblies 91 comprise obliquely disposed braces 92 which are supported by and secured to the corresponding left and right frame members 15 and 16 by means of triangular braces 93 (also illustrated in FIG. 13). Removably affixed to the terminus of the oblique braces 92 by pins 94 or other suitable retaining means are the scraper shoes 95. The scraper shoes 95 are positioned closely adjacent the spokes 71 of the bucket assemblies 20 and are offset or staggered such that a leading edge of one of the scraper shoes 95 is forward of the leading edge of the other scraper shoe 95 as is illustrated in FIG. 14. The staggered arrangement of the scraper shoes 95 is a significant feature inasmuch as this arrangement precludes engagement and locking of a stone or small boulder between the leading edges of the scraper shoes 95 and the spoke 71 of one of the bucket assemblies 20. By virtue of the staggered leading edges of the scraper shoes 95 a stone balanced on the spoke 71 of a bucket assembly 20 will be initially deflected to one side by the leading edge of the leading scraper shoe 95, thus precluding entrapment of the rock between the spoke 71 and the two scraper shoes 95.

Referring to FIG. 16, the radial position of the scraper shoes 95 relative to the trenching wheel assembly 19 and specifically the support rails 32 and bucket spokes 71 may be seen. The scraper shoes 95 remove spoil from the portion of the bucket assemblies 20 most proximate the support rails 32. It should thus be apparent that the cleaning arms 86 and the scraper shoes 95 cooperate to fully remove collected spoil from the bucket assemblies 20 and the wheel assembly 19 as such assemblies rotate thereby.

Referring now to FIG. 10, the chute assembly 25 includes symmetrical, obliquely disposed spoil aprons 97 which are positioned centrally within the left and right pentagonal frame members 15 and 16, respectively. The spoil aprons 97 comprise vertical front and rear end panels 98 (also illustrated in FIG. 1) disposed on opposite ends of two inclined plates 99. The inclined plates 99 extend outwardly somewhat beyond the frame members 15 and 16 and direct spoil which has been removed from the wheel and bucket assemblies 19 and 20 by the spoil removal assembly 24 to the left and right sides of the narrow ditch trencher 10. The spoil aprons 97 are supported by a generally symmetrical support structure 100 which is secured to the transverse braces 17 of the frame assembly 14. The spoil aprons 97 preferably are positioned saddle-like over the support structure 100 and the left and right pentagonal frame members 15 and 16 and are retained there by gravity. This mounting arrangement facilitates removal of the aprons 97 for inspection and adjustment of the symmetrical drive assembly 21 and other components of the narrow ditch trencher 10.

Referring now to FIGS. 1 and 15, a spoil and rock cleaner 101 is secured to both the left and right side upper forward portion of the support frame 44 by two threaded fasteners 102. The cleaner 101 is generally of right-angle configuration and projects into the channel defined by the flat annulus 31, the support rail 32 and the circular gear rack 33. The cleaner 101 thus removes spoil, rocks and other debris which may be carried upwardly toward the symmetrical drive assembly 21 and possibly interfere with its operation.

SHOE ASSEMBLY

Referring again to FIG. 1, the shoe assembly 26 comprises a generally hollow frame having a width substantially equal to the width of the bucket assemblies 20. Outside walls 104 of the shoe assembly are preferably fabricated of a smooth material such as stainless steel upon which spoil, particularly moist clay and similar soils, will not collect. The shoe 26 includes suitable guide means such as a hoop 105 and rollers 106 which direct a continuous length of plastic drain pipe 107 to the bottom of the just completed trench. The shoe assembly 26 may also include a weighted roller assembly 108 having a control arm 109 which may be positioned to apply or remove a downwardly directed force through the roller assembly 108 to the plastic drain pipe 107 to ensure that the pipe 107 is positioned accurately and positively at the bottom of the trench produced by the narrow ditch trencher 10.

Referring now to FIGS. 1, 12 and 17, the shoe assembly 26 is selectively attached to the frame assembly 14 of the narrow ditch trencher 10 by menas of the plural locking mechanisms 27. The locking mechanisms 27 comprise a plurality of adjustable, pivotable arms 111 which terminate in a yoke 112. Secured to the upper portion of the shoe assembly 26 by bracing struts 113 are a plurality of transversely oriented pins 114. Rotatably secured about the pins 114 are a like plurality of locking collars 115. When the locking collars 115 are rotated to their downwardly directed position, as illustrated in FIG. 17, the yokes 112 disposed on the pivotable arms 111 may be lowered to engage the transverse pins 114. The collars 115 may then be rotated, as indicated in FIG. 17 to the upright position illustrated in FIG. 12, such that the yokes 112 are retained on the transverse pins 114. A suitable retention means such as an expansion spring 116 may be positioned in suitable mounting means on the yokes 112 and the collars 115 to maintain the collars 115 in an upright position, thereby retaining the yokes 112 in position on the transverse pins 114. It should thus be appreciated that the shoe assembly 26 may be simply and conveniently attached to or removed from the frame assembly 14 of the narrow ditch trencher 10 as conditions or requirements necessitate.

OPERATION

Operation of the narrow ditch trencher 10 is straightforward. With the narrow ditch trencher 10 including the shoe assembly 26 raised above the level of the ground by the cable and which assembly 12, tractor 11 and the trencher 10 may be oriented appropriately to begin digging a trench. The power take-off 13 of the tractor 11 is engaged, causing power to be transferred through the left and right chains 22 and 23, respectively, to the symmetrical drive assembly 21 producing rotation of the trenching wheel assembly 19. The rotating trenching wheel assembly 19 and revolving bucket assemblies 20 engage and lift the soil upward until it drops from the bucket assemblies 20 or is dislodged by the spoil removal assembly 24. Spoil thus removed falls, is directed outwardly by the spoil aprons 97 and collects uniformly on opposite banks of the freshly dug trench. Forward movement of the narrow ditch trencher 10 and the tractor 11 permits the shoe assembly 26 to be lowered to the cut depth of the trench. When the appropriate depth has been reached, the plastic pipe 107 is fed through the shoe assembly 26, under the rollers 106 and 108, to the bottom of the trench. Friction of the plastic pipe 107 against the bottom of the trench produced by the weighted roller 108 as well as a small portion of the spoil which re-enters the trench after the passage of the trenching wheel assembly 19 and the shoe assembly 26 retains the plastic pipe 107 at the bottom of the trench. The narrow ditch trencher 10 and tractor 11 are advanced along the intended installation path of the plastic pipe 107 to its termination at which point it may be lifted from the trench by means of the cable and winch assembly 12 and realigned for additional trenching passes.

It should be noted that the capability of separating the shoe assembly 26 from the frame assembly 14 by means of the locking mechanism 27 is highly advantageous if the trenching wheel assembly 19 encounters a substantially immovable object such as a large boulder. If this should occur, the shoe assembly 26 may be disconnected by means of the locking mechanisms 27 and left precisely on grade at the bottom of the trench. The trencher 10 may then be moved from the trench and the boulder or other obstacle removed by a back hoe or similar means. After the object has been removed, the trencher 10 may be repositioned in the trench and realigned with the shoe assembly 26 and locking mechanisms 27. When so realigned, the trencher 10 will again be digging at the same depth as it was prior to encountering the obstacle and repeated adjustment and trials of the cutting depth of the trenching wheel assembly 19 will be obviated.

Operation of the narrow ditch trencher 10 is enhanced by several features which have been previously described. First of all, a generally "C" shaped volume within the trenching wheel assembly 19 is occupied by the support frame 44 having substantially smooth vertical sidewalls comprised of the covers 49 and 50. This structure extends substantially the full width of the dug trench and prevents freshly dug spoil from returning thereinto. As such it improves the overall efficiency of the narrow ditch trencher 10 by preventing it from repeatedly displacing spoil. The portions of the covers 49 which define the periphery of the support frame 44 extends radially outwardly into close proximity with the support rails 32 of the trenching wheel assembly 19, as is illustrated in FIG. 3. As such, the covers 49 protect the circular gear racks 33 and prevent rocks and other debris from accumulating thereon and interfering with the operation of the trencher 10.

The angle of the flared conical bucket blade 74 relative to a line tangent to a circle defined by the loci of the bucket assemblies 20 is also significant. As previously explained, the angle is preferably between 15° and 25°. This angular orientation of the conical blade 74 pulls the bucket assemblies 20 into the spoil bank and ensures optimum performance.

Lastly, reference to FIGS. 10 and 11 clarifies the cooperation between the support rails 32 and the bucket assemblies 20 of the trenching wheel assembly 19. The support rails 32 provide a surface against which spoil loosened by the bucket assemblies 20 is loosely wedged. Cooperation between the support rails 32 and the arcuate bucket plate 72 provides sufficient frictional engagement with the spoil to lift it from the bottom of the trench. The generally open-walled bucket assemblies 20 are then easily emptied by gravity and the spoil removal assemblies 24 previously described. The outwardly flared and open-walled bucket construction substantially reduces the power requirements of the narrow ditch trencher 10.

The foregoing disclosure is the best mode devised by the inventor for practicing this invention. It is apparent, however, that methods incorporating modifications and variations to the instant invention will be obvious to one skilled in the art of narrow ditch trenchers. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

What I claim is:

1. A narrow ditch trencher comprising, in combination, a rigid frame, a trenching wheel supported for rotation about a horizontal axis, means intermediate said frame and said trenching wheel for supporting said wheel for rotation about said axis, a plurality of bucket assemblies disposed about said trenching wheel, said bucket assemblies having a radially extending spoke rigidly secured to said trenching wheel, and a curved plate rigidly secured to said spoke, said curved plate having side edges spaced from said trenching wheel and said spoke, said curved plate having a trailing portion disposed substantially tangentially to said axis and a leading portion disposed at an angle to said tangential trailing portion, a pair of circular gear racks secured to said trenching wheel, an annulus disposed on said trenching wheel intermediate said bucket assemblies and said gear racks and having a width approximately equal to the width of said curved plates, generally planar spaced-apart sidewall members disposed within the lower portion of said trenching wheel, said sidewall members having curved marginal edges extending radially outwardly at least as far as said circular gear racks, and a pair of spoil removal arms secured to said rigid frame and having spoil removing ends disposed adjacent said trenching wheel at distinct circumferential positions, whereby rotation of said trenching wheel engages and lifts soil from below ground level.

2. The narrow ditch trencher of claim 1 wherein said trenching wheel defines a vertical reference midplane and said radially extending bucket spokes are disposed substantially coincident with said midplane.

3. The narrow ditch trencher of claim 1 wherein at least one of said bucket assemblies includes at least two spaced-apart cutter teeth disposed on said leading portion.

4. The narrow ditch trencher of claim 1 wherein said wheel supporting means includes at least one stub shaft defining an axis, said axis parallel to and spaced from said horizontal axis, a roller rotatably disposed on said stub shaft, a pair of spaced-apart plates secured to said shaft and disposed adjacent said frame, means for translating said plates, stub shaft and roller relative to said frame along a substantially radial axis, and means for selectively securing said plates to said frame.

5. The trenching wheel of claim 1 wherein said ends of said spoil removal arms are disposed adjacent said annulus on said trenching wheel.

6. The trenching wheel of claim 1 further including a second pair of resilient spoil removal arms, pivot means for securing each of said second pair of arms to said frame, and spring means operably disposed between each of said second pair of arms and said frame.

7. A narrow ditch trencher comprising, in combination, a rigid frame, a trenching wheel supported for rotation about a horizontal axis by said frame, a plurality of bucket assemblies disposed about said trenching wheel, said bucket assemblies including a radially extending spoke member rigidly secured to said trenching wheel and a curved plate rigidly secured to said spoke, said curved plate having side edges spaced from said trenching wheel and a first region disposed substantially tangentially to the axis of said trenching wheel and a second region disposed adjacent said first region and at an angle thereto, said second region having a leading edge disposed at a radially greater distance from the axis of said trenching wheel than a trailing edge of said first region, a pair of circular gear racks secured to said trenching wheel, an annulus secured to said trenching wheel intermediate said bucket assemblies and said gear racks and extending axially outwardly from said wheel, generally planar spaced-apart sidewall members disposed within the lower portion of said trenching wheel, said sidewall members having curved marginal edges extending radially outwardly at least as far as said circular gear racks, at least one pair of spoil removal arms secured to said rigid frame, each of said pair of arms terminating in an edge means for removing spoil from said trenching wheel and disposed at distinct, circumferentially nonaligned positions adjacent said trenching wheel and at least a second pair of spoil removal arms, pivot means for securing each of said second pair of arms to said frame and spring means operably disposed between each of said arms of said second pair of arms for providing a biasing force thereto.

8. The narrow ditch trencher of claim 7 further including means for positioning a pipe within a trench, and a plurality of locking mechanisms interposed said just recited means and said frame for selectively coupling and freeing said just recited means to and from said frame, said locking mechanisms including a shaft, a U-shaped locking collar rotatably disposed upon said shaft and a shaft engaging hook whereby said hook may be retained upon said shaft by rotation of said locking collar.

9. The narrow ditch trencher of claim 7 wherein said sidewall members are spaced apart a distance substantially equal to the width of said curved plates of said bucket assemblies.

10. A narrow ditch trencher comprising, in combination, a rigid frame, a trenching wheel defining a vertical reference midplane and having a pair of circular gear racks symmetrically disposed on opposite sides of said midplane, drive pinion means for engaging said circular gear racks, at least one adjustable roller means intermediate said trenching wheel and said frame for rotatably supporting said trenching wheel for rotation about a horizontal axis including means for supporting said roller means, means for translating said supporting means along a substantially radial axis and means for selectively securing said supporting means to said rigid frame, a plurality of bucket assemblies disposed about said trenching wheel, said bucket assemblies having a radially extending spoke rigidly secured to said trenching wheel, and a curved plate rigidly secured to said spoke, said curved plate having side edges spaced from said trenching wheel and said spoke, said curved plate having a trailing portion disposed substantially tangentially to said axis and a leading portion disposed at an angle to said tangential trailing portion, an annulus secured to said trenching wheel intermediate said bucket assemblies and said circular gear racks and oriented symmetrically about said midplane and concentrically about said axis, said annulus having a width substantially equal to said curved plate of said bucket assemblies, means secured to said frame for removing spoil from said bucket plates and said spokes including at least one pair of circumferentially non-aligned blades disposed adjacent said spokes, and a frame insert secured to said frame and disposed within a portion of said trenching wheel, said frame insert having substantially parallel vertical sides extending radially outwardly at least as far as said gear racks and width substantially equal to the width of said curved plates.

* * * * *